US006203168B1

(12) United States Patent
Bahar et al.

(10) Patent No.: US 6,203,168 B1
(45) Date of Patent: Mar. 20, 2001

(54) PROCESS FOR USING AN ILLUMINATING BOX TO ASSIST IN INSTALLING TILE

(76) Inventors: Reuben Bahar, 23708 Welby Way, West Hills, CA (US) 91307; Moshe J. Ozeri, 23036 Burbank Blvd., Woodland Hills, CA (US) 91367

( * ) Notice: Subject to any disclaimer, the term of this patent is extended or adjusted under 35 U.S.C. 154(b) by 0 days.

(21) Appl. No.: 09/458,735

(22) Filed: Dec. 13, 1999

(51) Int. Cl.[7] ..... F21S 8/00
(52) U.S. Cl. ..... 362/153; 362/253; 362/147
(58) Field of Search ..... 362/253, 147, 362/145, 153; 52/747.11, 749.11; 33/227, 228, 263, 275 R, 286

(56) References Cited

U.S. PATENT DOCUMENTS 4,543,765 * 10/1985 Barrett ..... 52/747
5,864,956 * 2/1999 Dong ..... 33/227
5,867,965 * 2/1999 Pitz et al. ..... 52/749.1
5,914,778 * 6/1999 Dong ..... 33/291

* cited by examiner

*Primary Examiner*—Thomas M. Sember
(74) *Attorney, Agent, or Firm*—Edgar W. Averill, Jr.

(57) ABSTRACT

A process for using an illuminating box for facilitating the level installation of tiles. The illuminating box has a top and four sides which are opaque. The bottom is light transmitting and lies in a single plane so that when a portion of the bottom is placed on one tile and the box is allowed to overhang an adjacent tile, light will escape on any area which lies below the bottom plane of the illuminating box. The process includes the steps of laying at least two tiles on a substrate and turning on the light in the illuminating box. Next, the box is placed on one tile so that its bottom edges extend over an adjacent tile. Next, the resulting light pattern on top of the floor tiles is observed to illuminate any lack of flatness.

5 Claims, 2 Drawing Sheets

PROCESS FOR USING AN ILLUMINATING BOX TO ASSIST IN INSTALLING TILE

BACKGROUND OF THE INVENTION

The field of the invention is floor, wall or cabinet tile installation and the invention relates more particularly to the laying of floor tile of the type which has a flat upper surface. In a construction project where new tiles are being laid, it is often difficult to place all the tiles at a common and equal height. It is important that the tile be laid at a uniform height so that the upper walking surface is free of any high or low spots. Most workers will utilize a level to help in determining whether all tiles are at the same height, but this has several drawbacks. First of all, some tiles are laid at a slight angle such as along a walkway where a level cannot be used. In the event the level is used simply to observe the relative position of two tiles, it is necessary for the worker to lower his eye level too close to that of the floor so that any gap can be observed. This is both time consuming and uncomfortable.

BRIEF SUMMARY OF THE INVENTION

It is an object of the present invention to provide a process for facilitating the leveling of tiles during installation.

The present invention is for a process for using an illuminating box for facilitating the level installation of tiles of the type which have a planar upper surface. The illuminating box has a housing having a top and four sides. The top and four sides are substantially opaque and form an interior chamber. A source of light is positioned within the interior chamber and is completely surrounded by the four sides and top. The four sides have bottom edges which are aligned in a single plane and define a footprint. The process comprises the steps of laying at least two tiles on a substrate, one of the tiles being a base tile. The light source is turned on and the housing is placed so that its bottom edges are co-planar with the base tile and the housing is positioned so that its footprint extends over at least a portion of the adjacent tile. This creates an observable light pattern. This light pattern is then observed to detect any lack of coplanarity between adjacent tiles. Preferably, the footprint is in the shape of an elongated rectangle. Also, the bottom surface is preferably covered by a transparent pane. The process is facilitated by the adding of at least two levels on the housing and observing the bubbles in the level during the installation process.

DESCRIPTION OF THE PREFERRED EMBODIMENTS

Figure 1:
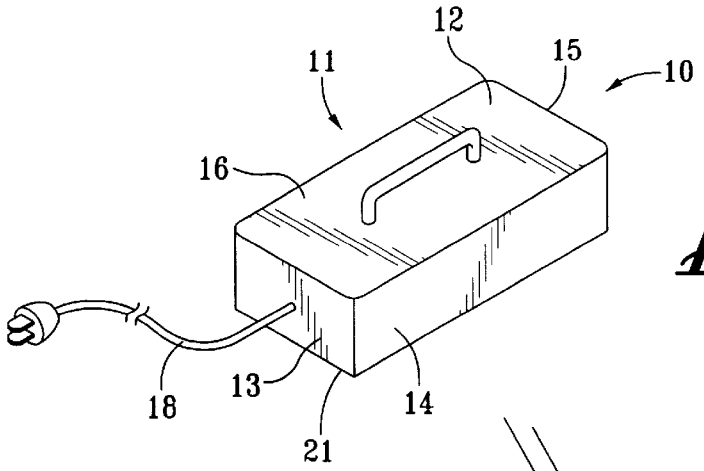
FIG. 1 is a perspective view showing the top, front and right side of the illuminating box used in the process of the present invention.

The illuminating box of the present invention is shown in perspective view in FIG. 1 and indicated generally by reference character 10. Illuminating box 10 has a housing 11 which includes a top 12, a front side 13, a right side 14, a back side 15 and a left side 16. A handle 17 is attached to top 12 to facilitate the manipulation of the illuminating box 10. The handle is not essential. An electrical cord 18 is shown in FIG. 1 and provides one method of energizing a light source within light box 10.

Figure 3:
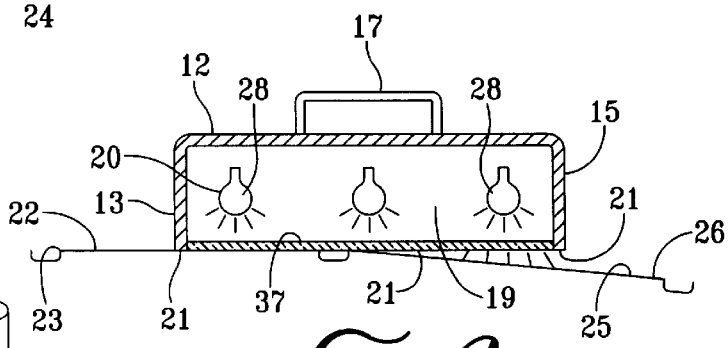
FIG. 3 is a cross-sectional view taken along line 3—3 of FIG. 2.

The interior of the light box is shown in FIG. 3 where the interior chamber is indicated by reference character 19. A source of light 20 is shown in FIG. 3 as three light bulbs 21.

Figure 2:
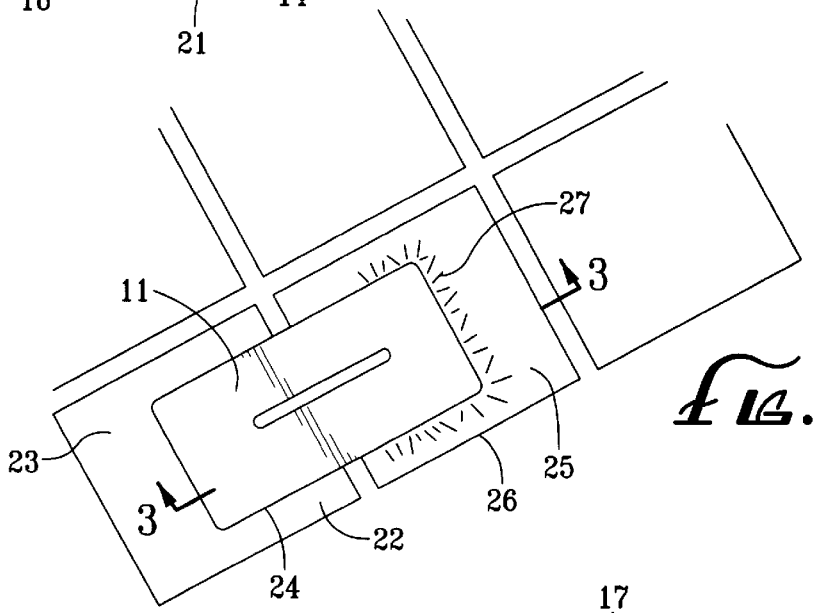
FIG. 2 is a plan view of the illuminating box of FIG. 1 resting over two tiles.

Housing 11 has a bottom edge generally indicated by reference character 21. Bottom edge 21 lies in a single plane. As shown in FIG. 2, bottom edge 21 is resting on a planar upper surface 22 of tile 23. Housing 11 forms a generally rectangular footprint indicated by reference character 24. When the bottom edge 21 is placed on the flat planar upper surface 22, it is positioned so that it overhangs the planar upper surface 25 of adjacent tile 26. As shown in exaggerated view in FIG. 3, adjacent tile 26 is not laid with its upper surface 25 on the same plane as upper surface 22 of tile 23. Bottom edge 21 thus overhangs the upper surface 25 of tile 26 and light is allowed to shine out from under bottom edge 21 as indicated by light pattern 27 shown in FIG. 2. It is, thus, easy to see that tile 26 must be releveled.

Figure 4:
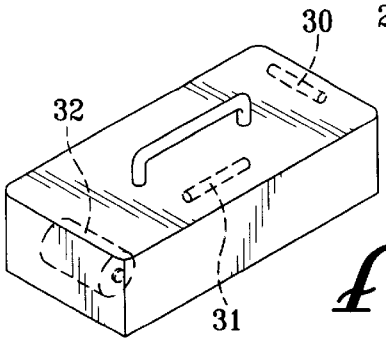
FIG. 4 is a perspective view of the illuminating box of FIG. 1 and further including a battery shown in phantom view and a pair of levels.

This lack of a consistent level surface is very easy to see with the process of the present invention and does not require the installer to place his eye level near the bottom of the illuminating box 10. The box may be made more useful for installing a flat surface by the addition of one or more levels such as levels 30 and 31 shown in FIG. 4. The levels may be bubble levels or electronic levels. The source of power to the light need not be an electrical cord, such as that shown in FIG. 1, but may, of course, be a battery, such as battery 32 shown in phantom view in FIG. 4.

Figure 5:
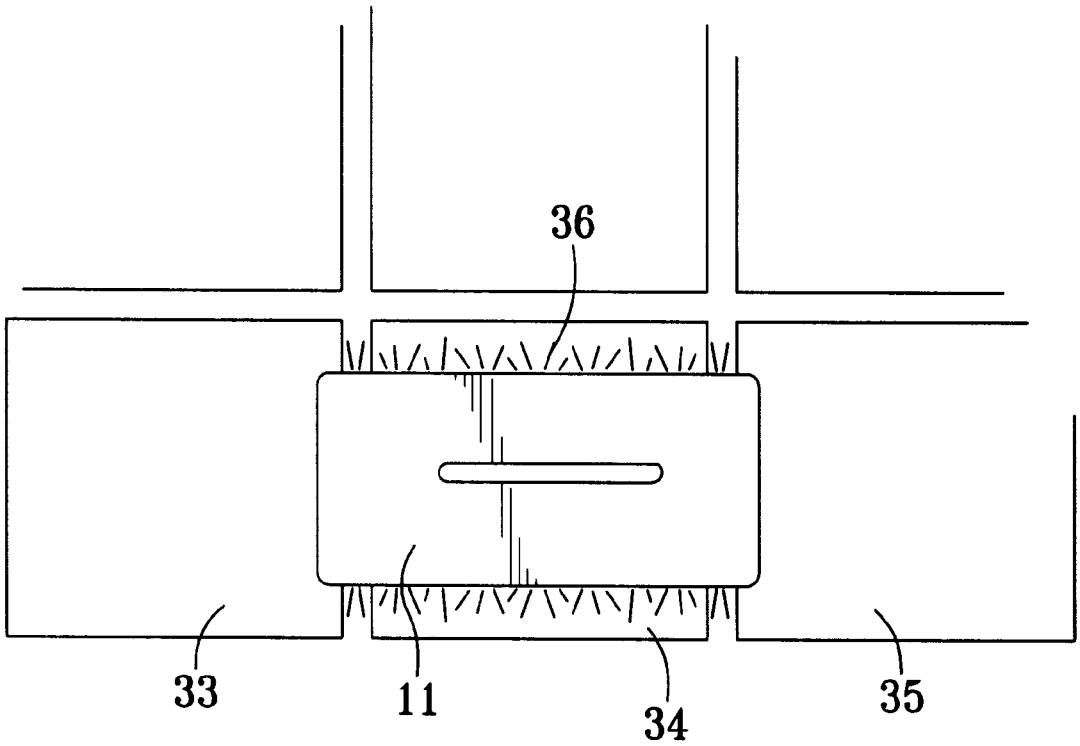
FIG. 5 is a plan view of the illuminating box of FIG. 1 resting on two separated tiles over an intermediate tile.

In addition to resting the bottom edge 21 on a single tile, it is also contemplated that the present invention can be carried out by spanning a tile such as shown in FIG. 5. Housing 11 is shown resting on tiles 33 and 35, thereby spanning tile 34. This produces a light pattern 36 in the event tile 34 is lower than tiles 33 and 35. In other words, the illuminating box can be utilized in several different ways depending on the size and pattern of tile on which the light box is used.

While lightbulbs are shown as the source of light in the drawings, it is, of course, to be understood that fluorescent bulbs, phosphorescence or any other source of light can be used in place of the lightbulbs. It is also to be understood that colored lights have some advantages, particularly where thee are other surces of white light in the work area. Colors such as red, green, blue or orange ar ontemplated. Wile the housing may have an open bottom, it is preferred that a transparent or translucent bottom plat be utilized, such as that indicated by reference character 37 in FIG. 3. While the term "substantially opaque" is used in the claims, it is intended to include small openings that would assist in illuminating the workspace while not interfering with the light pattern. While a generally rectangular footprint is shown in the drawings, it is also contemplated that the housing could be oblong, hexagonal or other shape, dependent largely on the type of tile surfaces with which the process of the present invention will be used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A process for using an illuminating box for facilitating the level installation of tiles of the type which have a planar upper surface, said illuminating box having a housing having a top and four sides, said four sides comprising a front side, a right side, a left side, and a back side, said top and four sides being substantially opaque and forming an interior chamber, a source of light within said interior chamber of said housing, said source of light being completely surrounded by said top and four sides, said four sides having bottom edges aligned in a single plane and define a footprint, said process comprising:

laying at least two tiles on a substrate, one of said tiles being a base tile and another of said at least two tiles being an adjacent tile;

turning on said source of light;

placing said housing so that its bottom edges are coplanar with said base tile and so that the footprint extends over at least a portion of said adjacent tile resulting in an observable light pattern; and observing said light pattern for a sign of any light shining between the housing and planar upper surfaces of said at least two tiles whereby any lack of coplanarity can be observed.

2. The process of claim 1 wherein said footprint is in the shape of an elongated rectangle.

3. The process of claim 1 wherein said interior chamber is enclosed by a light transmitting panel extending no further from the bottom edges than said single plane.

4. The process of claim 1 wherein said housing has at least one level mounted thereon and the process includes the further step of observing the level.

5. A process for using an illuminating box for facilitating the level installation of tiles of the type which have a planar upper surface, said illuminating box having a housing having a top and a peripheral side wall, said peripheral side wall being connected to the top so that an interior chamber is formed and the peripheral side wall having a bottom edge lying in a single plane outlining a footprint, said top and peripheral side wall being substantially opaque, a light source within said interior chamber of said housing, said light source being completely surrounded by said top and peripheral side wall, said process comprising:

laying at least two tiles on a substrate, one of said tiles being a base tile and another of said at least two tiles being an adjacent tile;

turning on said light source;

placing said housing so that its bottom edge is coplanar with said base tile and so that the footprint extends over at least a portion of said adjacent tile thereby creating a light pattern adjacent said bottom edges; and observing the light pattern for a sign of any light shining between the planar upper surfaces of said at least two tiles and the bottom edges whereby any lack of coplanarity can be observed.

* * * * *